United States Patent [19]

Karper

[11] 4,140,354

[45] Feb. 20, 1979

[54] MINI-CARD TRAY ROTARY FILE STRUCTURE AND SYSTEM

[76] Inventor: Albert Karper, 5700 Collins Ave., Miami Beach, Fla. 33140

[21] Appl. No.: 924,793

[22] Filed: Jul. 14, 1978

[51] Int. Cl.[2] ..... A47B 63/00

[52] U.S. Cl. ..... 312/186; 312/59; 312/97.1; 312/189; 211/53

[58] Field of Search ..... 312/185, 186, 187, 188, 312/189, 183, 59, 97.1, 284; 211/50, 53

[56] References Cited

U.S. PATENT DOCUMENTS

| | | | |
|---|---|---|---|
| Re. 28,927 | 8/1976 | Karper | 312/186 |
| 1,475,555 | 11/1923 | Sargeant et al. | 312/186 |
| 2,389,923 | 11/1945 | Miller | 312/189 |
| 2,424,144 | 7/1947 | Bruen | 312/189 |
| 2,441,717 | 5/1948 | Nero | 312/189 |
| 2,731,966 | 1/1956 | Neilsen | 312/189 |
| 3,253,871 | 5/1966 | Karper | 312/284 |
| 3,261,649 | 7/1966 | Erickson et al. | 312/189 |
| 3,602,563 | 8/1971 | Karper | 312/189 |
| 3,734,587 | 5/1973 | Karper | 312/186 |
| 3,817,393 | 6/1974 | Neilsen | 312/183 |

FOREIGN PATENT DOCUMENTS

| | | | |
|---|---|---|---|
| 2356584 | 11/1973 | Fed. Rep. of Germany | 312/186 |

*Primary Examiner*—Victor N. Sakran

[57] ABSTRACT

A mini-card rotary file structure and system which includes a rotor support and a rotor spanning the support with a plurality of card tray support fins arranged in intersecting chordal planes on the rotor and slidably removable mini-card holder and transfer trays engaging the fins and wherein the trays are provided with tracks to engage recesses in mini-cards to be slidably captivated by the tracks on the trays for rotation with the rotor into and out of a generally tilted and horizontal attitude and wherein a base or several bases may be provided to support mini file card holder and transfer trays removed from the rotor for convenient arrangement of one or several trays at one or several work stations.

16 Claims, 21 Drawing Figures

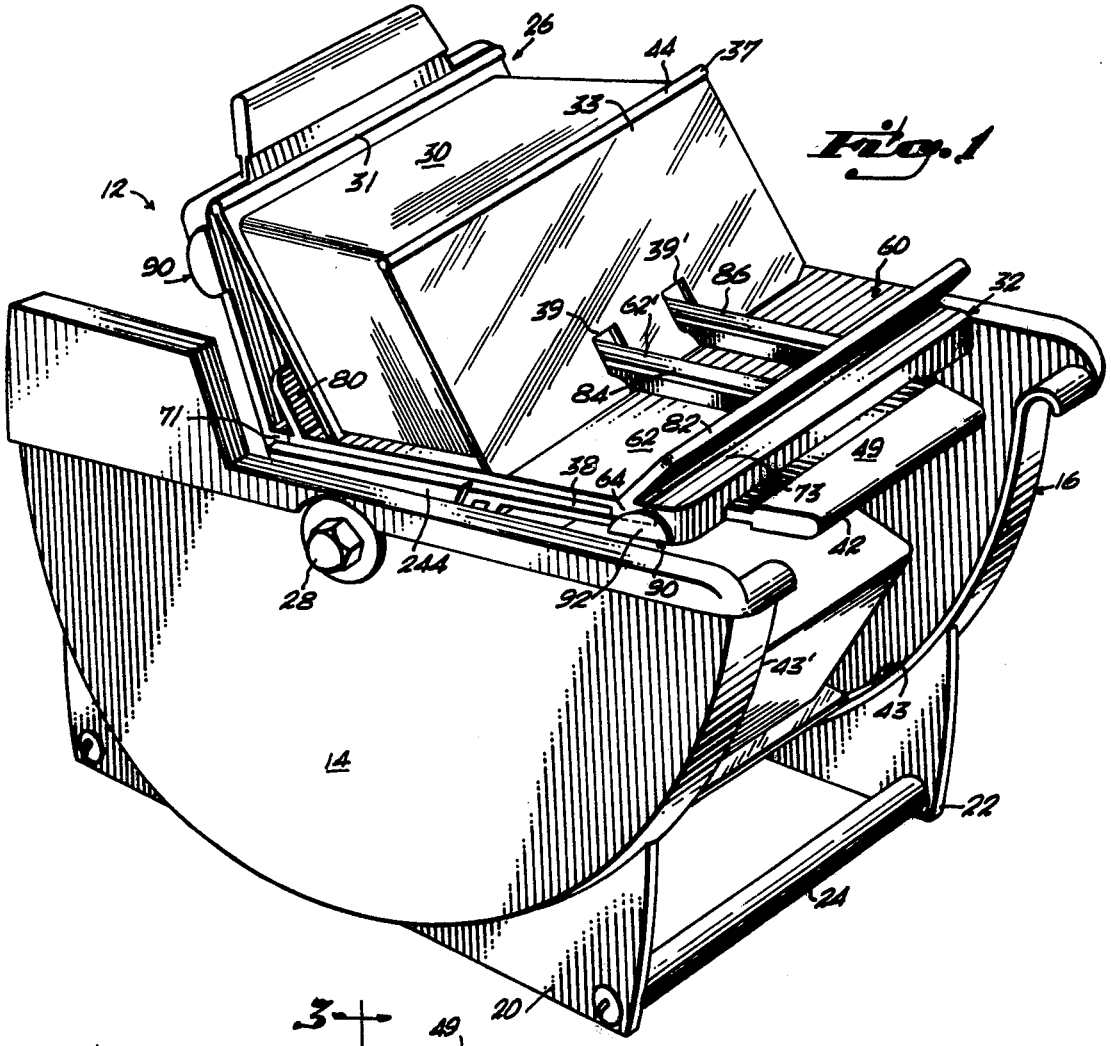
Fig. 1
Fig. 2
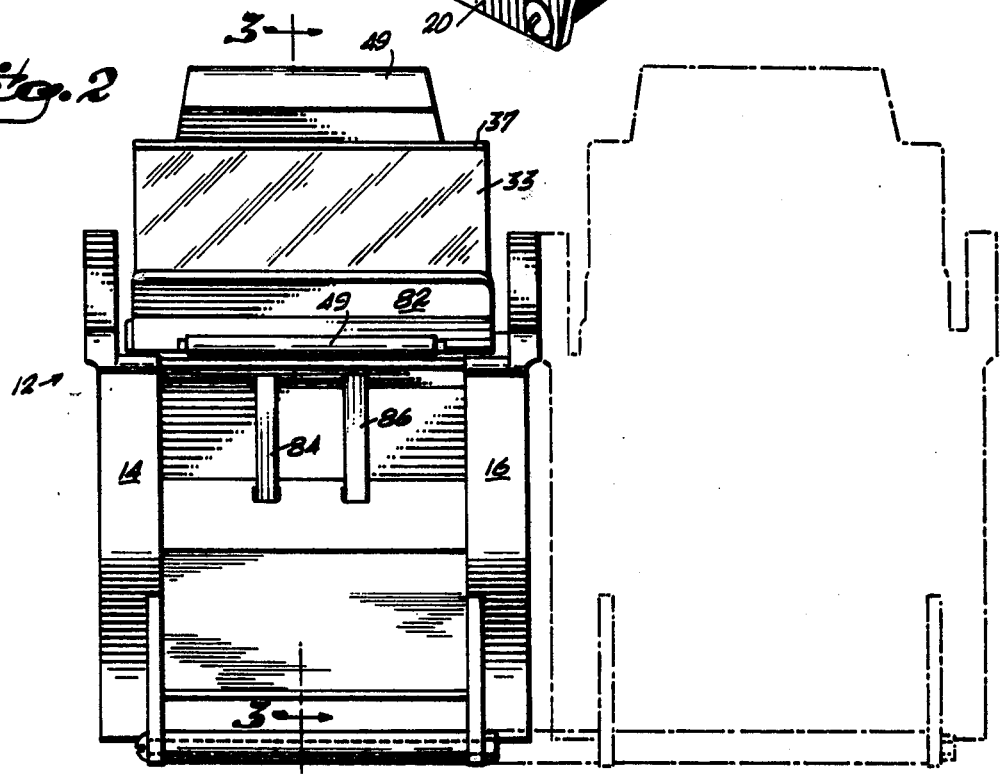

MINI-CARD TRAY ROTARY FILE STRUCTURE AND SYSTEM

FIELD OF THE INVENTION

This invention relates to a multi purpose mini-card rotary file structure and system.

BACKGROUND OF THE INVENTION

In the prior art, card files are known, such as that of U.S. Pat. Nos. 3,253,871; 3,602,563; and 3,734,587, the latter being by the present inventor.

This invention, generally, is of a compact desk-top rotary card filing system for either open or closed housings. It is a general purpose of this invention to provide structure for a filing system which uses a minimum number of dies and molds because the structure is interchangeable being composed of similarly structured parts so as to create interchangeability in the assembly process in order to provide a wide range of size and capacity of a file system and wherein the rotary files are adapted to be manufactured at economical cost. The rotary card filing system provides a circularly disposed body structure which will permit easy sliding contact of formed card guards which serve to compress the filed cards upon rotation of the rotor, saving wear and tear on the card groups and at the same time lowering the profile of the housing in order to provide a compact high volume rotary file for desk top use.

This invention is of an improved structure comprising a multi purpose mini-card tray rotary card filing system. The structure provides for using mini-card trays which are adapted for forward-to-rearward or side-to-side sliding movement of insertion or removal along guide tracks provided on tray supports on a main file rotor on which mini-card trays may be worked, or, alternatively, one or several of the card trays may be slidably removed from the rotor and positioned on transfer tray bases which may either be of the single or multiple type. The main rotor file structure may also be a single or a multiple rotor type rotatably mounted on a common horizontal shaft or in separate side-by-side units. The rotor is capable of supporting trays or mini-card trays, with cards in the trays for fixed track movement and which cards include in each group, if desired, index cards and an inner and outer card guard to protect the cards in rotational movement and in moving the trays from a position on the rotor of the rotary file to a transfer tray base or transbase at a work station removed from the rotor.

Generally speaking, it is an object of this invention to provide an improved mini-card rotary file structure for multi purposes use, which can be used in an open housing structure or a closed housing structure; and wherein the housing of the structure is adapted to be interconnected in side-by-side relation with two or more similar units to permit large volume card capacities and wherein the cards of the filing system are removably captivated on card holder and transfer trays which may be slidably removed from the rotary structure and utilized on transfer tray bases arranged at suitable work stations or locations and which bases have companionate track means for interengaging with the card holder and transfer card trays.

It is thus seen that this invention provides a filing system using a structural arrangement of a desk top rotary card file which will permit in-line filing of cards for rapid filing and location and wherein the cards are arranged on tracks in removable trays which are adapted to be utilized in the rotary card file as separate mini-card trays at work stations to permit divisional use. The card holder and transfer trays are easily removed from the main rotor and may be used on a single or multi transbase whereby the card trays may be slidably mounted for desk top use where work distribution is desirable of some or all of the cards of the rotary file by numerous number of persons at numerous stations. The structural means for interconnecting the trays to the rotor and transfer bases provide for slide movement of the card holder and transfer trays for use in either a slide-in slide-out forward to rearward movement or a sideways movement. The structure described hereinafter provides for a comparatively quiet operation and includes detent means for positive positioning and moving of the rotor between orienting positions of the mini-card trays as an adjunct to this rotary system and the card holder and transfer trays and includes self-orienting means and a rotor braking system.

Finally, card guards are utilized for groups of cards and indexes which are relatively enlarged to ride within predetermined runs and protectively compact the cards upon rotation so that there will not be damage upon rotation of the rotor of the structure described hereinafter or upon removal of a card tray from the main rotor file unit to a transfer tray base for a division of the work; and to this end the card guards are provided with resilient wall or run upon rotation of the rotor carrying a large number of cards, as is described more fully hereinafter and shown in the drawings.

Generally speaking, it is an object of this invention to provide an improved card rotary file structure and system which is improved and which is adapted for relatively large filing systems and which may be separated into discrete components of work for division of the work at various work stations for rapid utilization by several persons simultaneously of a relatively large number of mini-card trays with stored information.

It is an overall object of this invention to provide an improved rotary card filing system in accordance with the description set forth herein for the objects set forth and which is simple and inexpensive to construct and easy to operate, maintain and install.

In accordance with these and the foregoing objects, the instant invention will now be described with reference to the accompanying drawings, in which:

DESCRIPTION OF THE DRAWINGS

FIG. 1 is a perspective view of a mini-card rotary file structure in accordance with the instant invention;

FIG. 2 is a front elevation view of the mini-card rotary structure of FIG. 1;

DESCRIPTION OF PREFERRED EMBODIMENT

Figure 3:
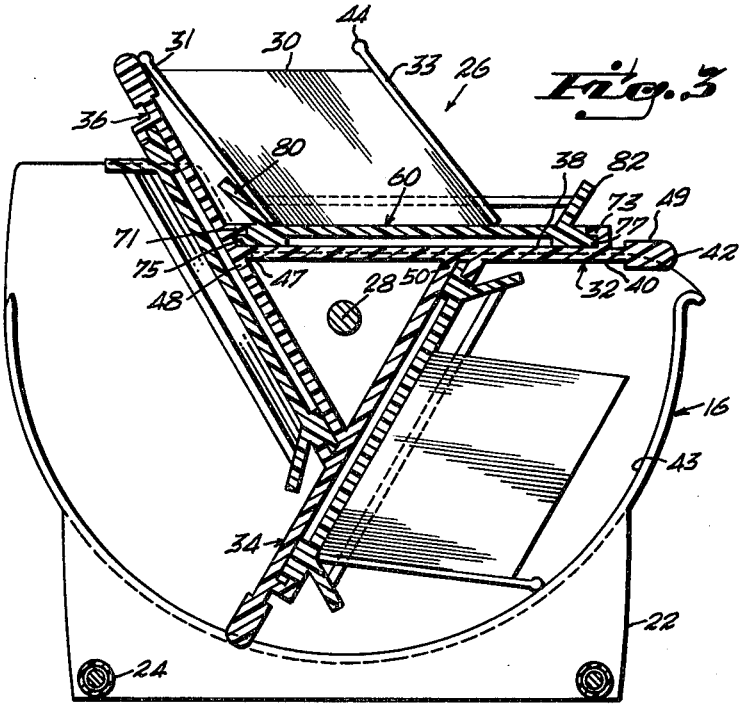
FIG. 3 is a view in cross section taken on a vertical medial plane through the structure shown in FIG. 1.

Referring to the drawings, and particularly to a first preferred embodiment shown in FIGS. 1, 2 and 3, there is shown a card rotary file structure generally designated by the numeral 12. It includes removable card holder and transfer trays which may be each normally stored on the rotor in a complete file system and separately removed for division of work using the cards of the system by mounting them upon desk top tray bases of single or multiple type as shown in FIGS. 15 through 20.

The structure in FIGS. 1, 2 and 3 is seen to include a rotor support which is composed of a first and second spaced side panel 14 and 16 each of which is provided with a lower file support surface or foot 20 and 22 to rest on a desk or the like. Suitable spacer means 24 are provided to maintain the side panels in predetermined spaced relation. A rotor generally designated by the numeral 26 spans the support frame; and it includes means journaling the rotor to the frame for rotation about an axis 28 generally perpendicular to and which runs through the first and second support panels of the frame and which is parallel to an extension of the bolt or shaft designated by that numeral 28 and seen just below the deck of cards 30 shown in FIG. 1.

As can conveniently be seen in FIG. 3, the rotor 26 includes a plurality of tray support fins, which are designated by the numerals 32, 34 and 36. Each of the tray support fins is of a common size and shape and, referring to tray 32, each has a card holder and transfer tray support surface or face, such as that designated by the numeral 38 and a bottom surface which is designated by the numeral 40. Additionally, each of the tray support fins has an outer edge 42 which is at a common radial distance from the centerline of the axis 28 of the rotor. It is thus seen that upon rotation of the rotor the outer edges, such as 42 of the tray support 32, will trace a circular cylindrical surface. Each of the three tray support fins of the instant embodiment are equi-angularly spaced from one another; and, further, each of the tray support fins is supported on the rotor so as to extend depthwise relative to the aforesaid circular cylindrical surface defining a chordal planes. Each fin extends from the outer edge, such as 42, of the tray support fin 32, past a diametrical plane of the rotor axis 28 which is perpendicular to the chordal plane; i.e., the fins are not radial but define equi-spaced chordal planes.

The equi-angularly spaced tray support fins of the rotor each have an inner end 47; and the inner end of each is supported at a zone, such as that designated by the numeral 48, by the adjacent tray support fin 36 which is angularly adjacent to it, it being noted that this zone is spaced depthwise from the outer cylindrical path so as to be beyond the aforesaid diametrical plane perpendicular to the chordal plane of the supported support fin 32. Further, the fin 32 is also supported intermediate its inner end 47 and outer edge 42 by the adjacent tray support fin 34 angularly adjacent to its bottom surface 40 at a location depthwise from the outer edge 42, a distance such that it is on the outer side of the aforementioned diametrical plane of the rotor perpendicual through the chordal plane. A strong rigid rotor with tray support fin is thus achieved.

The rotor of each embodiment provides a surface such as that designated by the numeral 49 which is radially spaced from the axis 28 upon which a tangential force may be applied to rotate the rotor with respect to the frame and to selectively orient each of the tray support fins in a generally horizontal attitude.

On each of the support fins, there is slidably and removably captivated a card holder and transfer tray such as that which is generally designated by the numeral 60 in FIGS. 1 and 3. The card holder and transfer tray can best be seen in FIGS. 7, 8, and, also, in FIG. 18. It is seen to include a card support or tray surface generally designated by the numerals 62 and 62′ and extending track means which may be in the form of an enlarged or outwardly extending bottom surface 64. The tray support surface 62 includes an inner and an outer edge 68 and 70 and parallel side edges 72 and 74 and in any event defines a card support bed. Each of the card holder and transfer trays is adapted to rest and ride on the support surface 38 of the tray support fins between the outer and inner edges 42 and 47 thereof. To this end track means or mutually interengaging means are provided on each of the card holder and transfer trays and on the tray support fins for captivated mating sliding engagement of the trays and to maintain the trays against movement of separation from the fins in a vertical direction when the rotor is rotated. In other words, the trays are captivated with respect to the tray support fins for sliding movement into and out of a predetermined position and thus adapted for rotation with the rotor.

In the embodiment of FIGS. 1 and 3, upstanding track means 71 and 73 are provided on the fins to interengage the outer edges 75 and 77 of the enlarged or outwardly extending lower bottom surface 64 of the mini-card holder and transfer tray, the upstanding channel members being sized to receive the edge and captivate the card holder trays for sliding movement thereacross. Each of the card holder trays, see FIG. 1, FIG. 7, FIG. 8 and FIG. 18, includes an inner and outer card orienting rail structure, see 80 and 82, which are generally parallel to the inner and outer edges and which are upstanding and diverging outwardly with respect to one another. Further, each of the card holder and transfer trays includes upstanding support tracks 84 and 86 which are parallel to one another and parallel to the side edges of the trays extending across each card holder and transfer tray between the inner and outer rail structure. Each of the tracks is provided with an enlarged distal or outer terminal edge for captivating engagement within the recesses of a deck of cards now to be described.

As shown in FIG. 1, a group or deck of cards 30 is adapted to be carried on each of the trays. Each of the decks includes a plurality of cards of common size and an inner and an outer card guard designated by the numerals 31 and 33 respectively. These card guards are of heavy duty relatively rigid sheet material and are slightly larger in all dimensions than the cards of the deck so that the outer edge of the card guards which is preferably enlarged as at 37 is adapted to run or ride on the inturned surfaces flanged circularly disposed or runs 43 and 43', see FIGS. 1 and 3. A bead edge 44 is preferably provided on the card guards to protect the cards in their downward shifting movement upon rotation of the rotor by compacting the cards for easy rotation as well as providing a back and front stop to lower the height or profile for desk top use and to protect the card when the card trays are removed from the rotor to be used with a card transfer tray base, which may be of the single or multi-transfer tray base type, as will be described more fully hereinafter. It will further be noted that each of the card guards is provided with a pair of recesses 39 and 39' extending from the lower edge 41' and which is enlarged from a slit mouth opening to accommodate mating engagement and to be captivated by the previously described track means for removable positioning in the mini-card holder trays.

As is seen at the upper left and middle right of FIG. 1 and generally designated by the numeral 90, a stop means, which is also designated by the numeral 92 on the support fin 32 is provided to limit lateral movement of the card holder trays parallel to the rotor axis 28 on the surface of the tray holder fin especially for use when multi-structures are arranged adjacent one another, see FIG. 2; the stop means are suitably located for ease of tray removeability. With respect to the embodiment shown in FIG. 7, because the direction of the guide tracks, generally designated by the numerals 100 and 101 in that Figure, are perpendicular, instead of parallel, to the axis 28 of the rotor, such stop means are not needed. On the other hand, in the embodiment shown in FIGS. 7, 8 and 9, a suitable stop means is provided to lock the card holder tray against radial movement in the direction of the arrowed line 103. This means will now be described with reference to FIGS. 8, 9 and 10.

Figure 9:
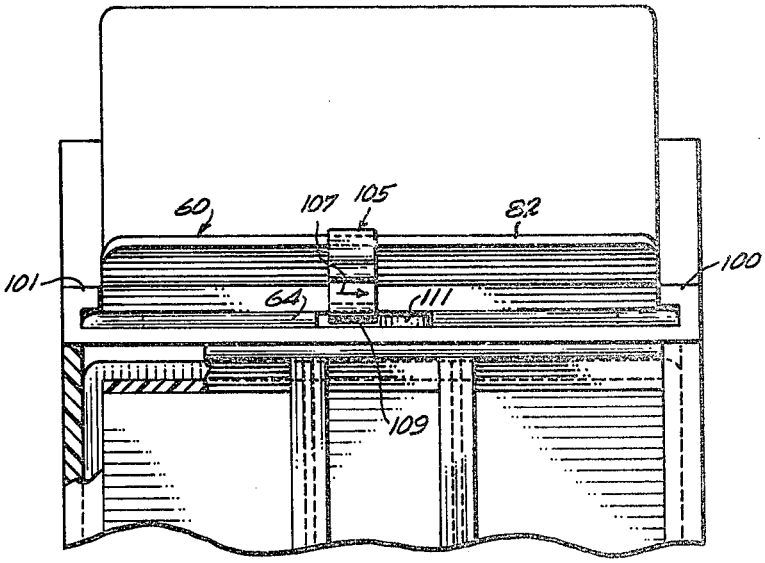
FIG. 9 is a front elevation view illustrating a means for releasably locking the card holder and transfer tray of FIGS. 7 and 8 to a tray support fin of a rotor in accordance with the instant invention.

The means comprise a clip 105 which is movable in the direction of the arrow 107 shown in FIG. 9 so that the lower hooked end 109 in adapted for abutment with an upstanding portion 111 of the card holder support fin. Other suitable means may be utilized to restrain radial movement of the card holder tray; and the embodiment shown in FIGS. 7, 8 and 9 for accomplishing this are intended to be illustrative of various types of devices which may be utilized to accomplish the same result.

Figure 10:
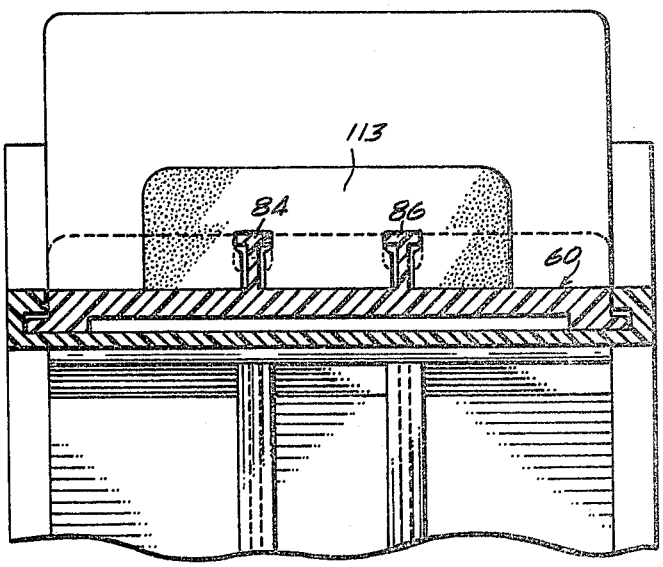
FIG. 10 is a view in cross section taken on a lateral plane of FIG. 7 rearwardly of the front elevation plane view shown in FIG. 9 and illustrating the card holder and transfer tray in cross section and its mating interengagement with guide track means on the tray support fin of the rotor.

Turning to FIG. 10, it is seen that a small rubbery pad type panel designated by the numeral 113 may be employed on one side of the plurality of cards to act in place of the above described card guard.

Figure 11:
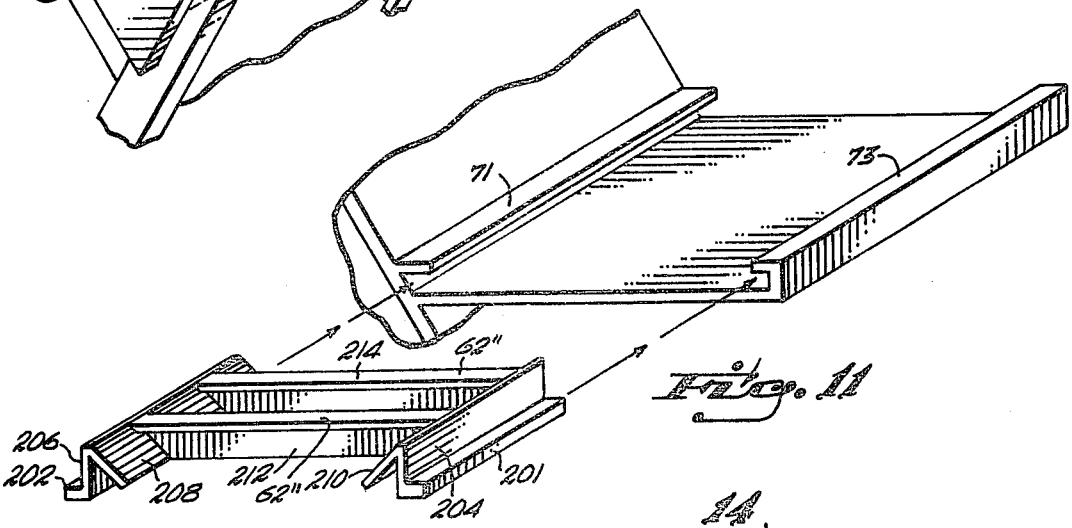
FIG. 11 is a partial perspective exploded view similar to FIG. 7 and illustrating an alternative construction for the tray support fin of the rotor and an alternative construction for the card holder tray; it being noted, however, that the card support holder and transfer tray shown in FIG. 7 is adapted to be utilized with the tray support fin shown in FIG. 7 or, alternatively, the tray support fin shown in FIG. 11.

Regarding the alternative structure shown in FIG. 11, the card tray may include the front track engaging structure 201 and the rear track structure 202 on the fins; the upstanding portions 204 and 206 and the inclined or diverging rail portions 208 and 210 which are spanned by the track means 212 and 214. It is noted that in this illustration of an alternative embodiment, the complete surface 62 may be eliminated since the weight of the cards is carried by the card support surface of the tray comprising the upper surface of the tracks 212 and 214.

Figure 7:
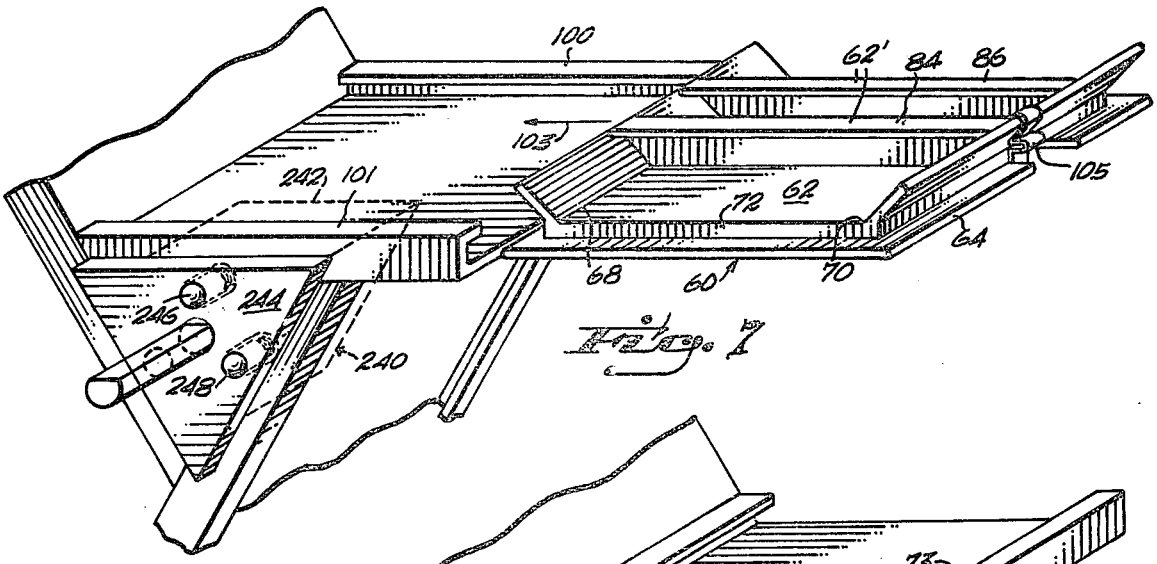
FIG. 7 is a perspective view of a portion of the rotor in the mini card rotary file structure and illustrating a card holder and transfer tray sized for sliding insertion into a tray guide track on a tray support fin of the rotor.
Figure 8:
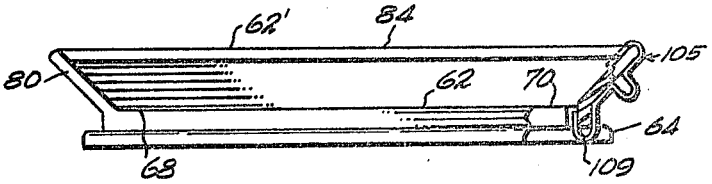
FIG. 8 is a side elevation view which has been partly broken away and which illustrates the mini card holder and transfer tray shown in FIG. 7.

Referring now to the rotor, as shown in FIG. 7, it is seen that in the preferred embodiment a triangularly shaped spacer block generally designated by the numeral 240 may be utilized which extends axially between the tray support fins. It includes a triangular portion 242 which extends axially inwardly between the fins and an axially outwardly extending spacer portion 244. The spacer portion comprises spacer means and houses detents which are spring-urged to an outer position, as shown in FIG. 7 and designated by the numerals 246 and 248, to engage correspondingly located recesses, not shown, at a common radial distance located in the inside surface of the frame panel 14, in the FIG. 1 embodiment, see the block 244 which is indicated in this view.

Figure 4:
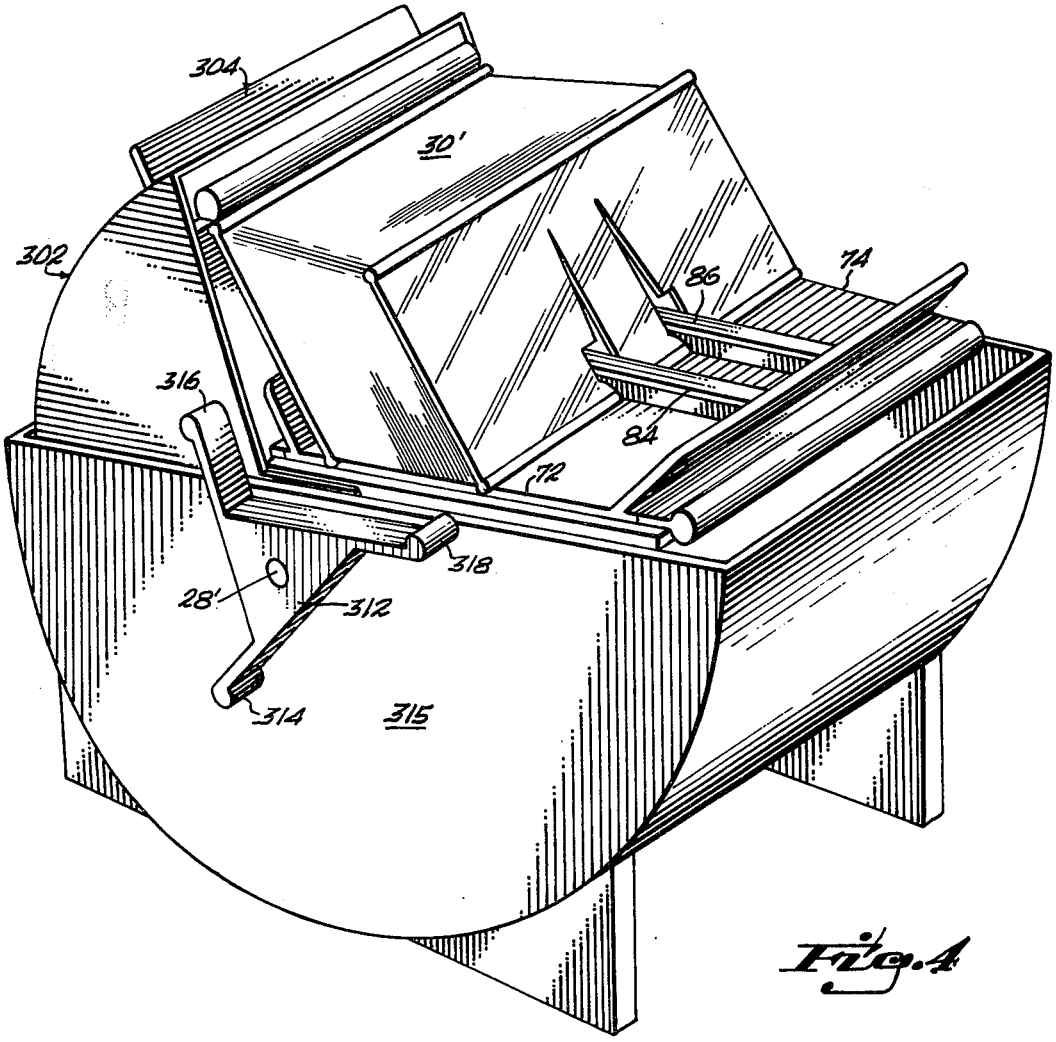
FIG. 4 is an alternative embodiment of the rotary card filing structure of the instant invention.
Figure 5:
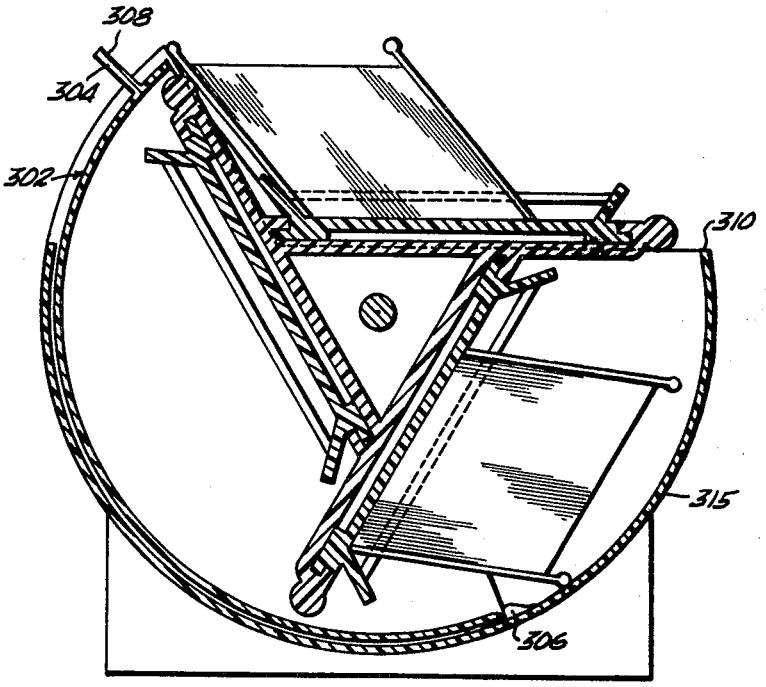
FIG. 5 is a view in cross section taken on a vertical medial plane of the structure shown in FIG. 4.
Figure 6:
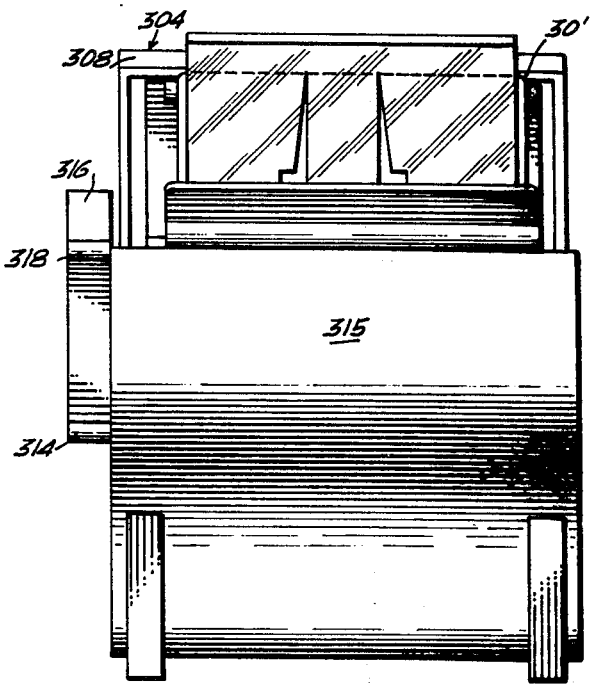
FIG. 6 is a vertical elevation view of the structure shown in FIG. 4.

With regard to the embodiment shown in FIGS. 4, 5 and 6 the previously described components will not here be redescribed. Rather, the slightly different features only of this embodiment will be described. A hood member 302 is connected for rotation about the rotor axis 28' for rotation upon application of a tangential force to the tab 304 to move the hood into and out of covering relation of the cards 30' for purposes of closing the tray holder. Stop means are provided as indicated by the numeral 306 in FIG. 5 to limit opening movement of rotation of the hood 302; and the surface 308 in engagement with the surface 310 comprises stop means to limit rotational movement of closing of the hood 302. The housing of this embodiment includes a front and bottom and rear wall portion 315 which protectively houses all of the cards so that none are open to dust and other contaminants when the hood 302 is closed. It will also be seen that in this embodiment, the means for turning the rotor comprises a knob 312 having radially projecting fingers 314, 316 and 318 which are adapted to be utilized for applying tangential force to turn the rotor conveniently.

Figure 14:
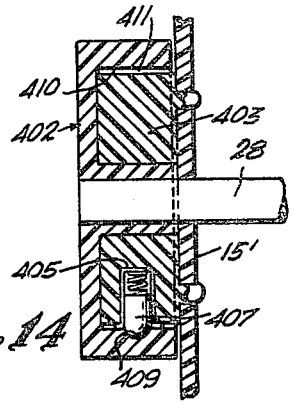
FIG. 14 is a view in cross section taken on the plane indicated by the line 14—14 of FIG. 13.
Figure 13:
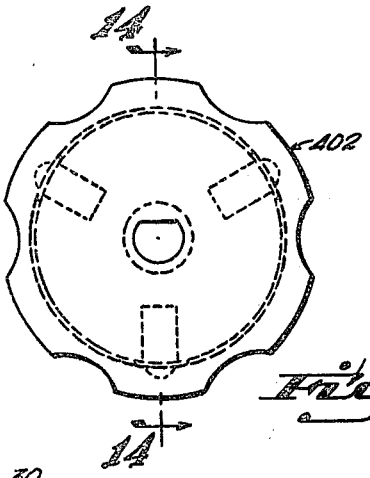
FIG. 13 is a view of a suitable turning knob structure to rotate orienting trays when carried on the rotor.

In lieu of the turning knob 312 shown in FIG. 4, the turning knob as shown in FIG. 13 and designated by the numeral 402 may be employed. This turning knob is shown in cross section in FIG. 14 wherein it is seen that it is keyed or fixedly mounted on the shaft or axis 28; and that it is rotatable on an annular ring 403 which extends outwardly from the housing in an annular recess in the knob. The ring is keyed against rotation on the frame panel support surface, designated by the numeral 15'. The ring is provided with radially extending recesses 405 within which spring-urged detents 407 are captivated to mate with corresponding recesses 409 in the inner run 410 of the inner recess 411 of the turning knob 402. The spring-urged detents act as positive positioning means, there being three in number as seen more clearly in FIG. 13 in the preferred embodiment, and also as brakes.

Figure 12:
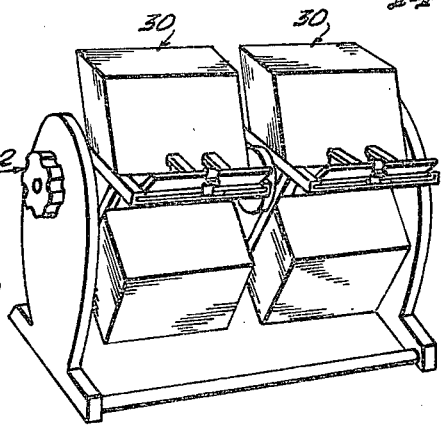
FIG. 12 is a perspective view illustrating a modified form of the mini card rotary file structure utilizing rotors in tandem supported on a common base.

As shown in FIG. 12, the embodiment of the card rotary file structure may be in tandem and be supported on a common base or, alternatively, tow of the card rotary file structures, as shown in FIG. 2, may be arranged in side-by-side adjacent relation; and, indeed, the same may be hooked up with one another and interconnected.

Figure 15:
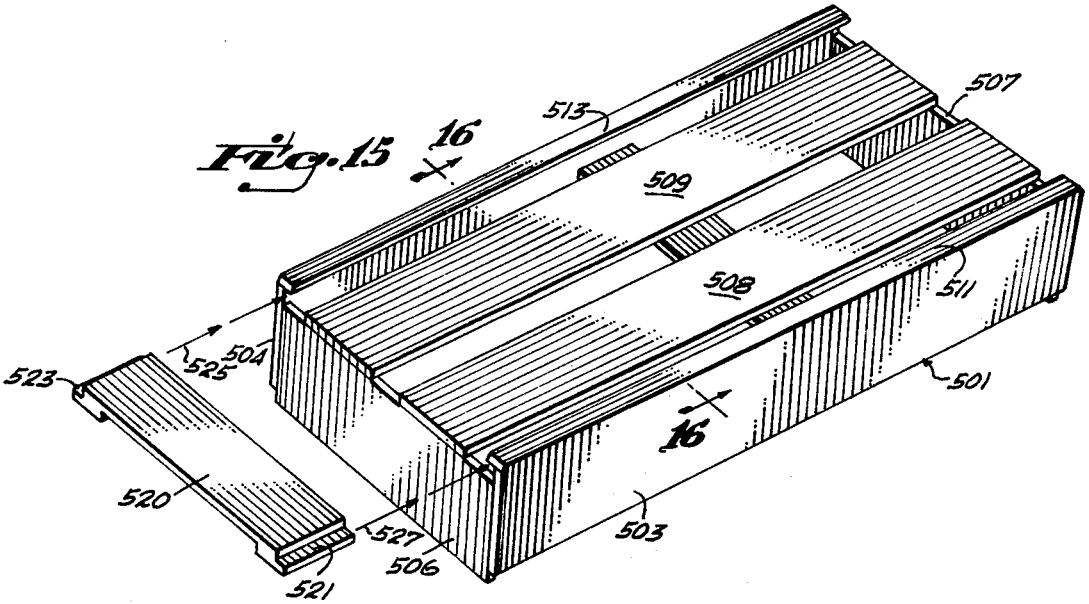
FIG. 15 is a perspective view of a multi card holder and transfer tray base, or transbase as it may be denominated.
Figure 16:
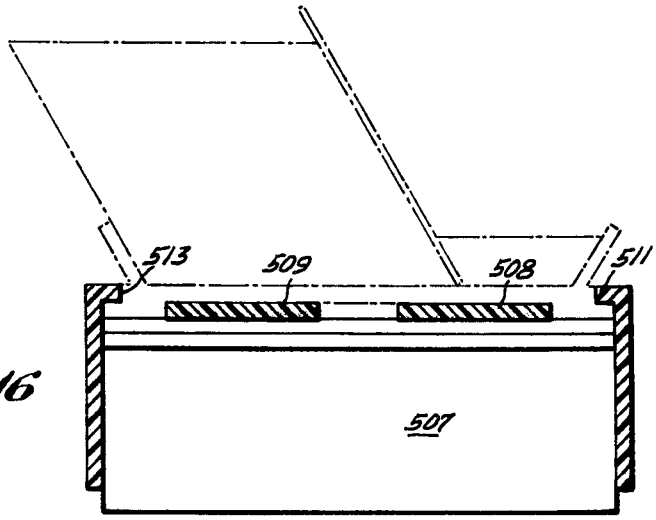
FIG. 16 is a view in cross section taken on the plane indicated by the line 16—16 of FIG. 15 and looking in the direction of the arrows.

Referring now to FIG. 15 there is shown a transfer tray support base which is intended to support at least two of the card holders and transfer trays, the base being generally designated by the numeral 501 and including front and rear wall sections 503 and 504 and end walls 506 and an opposite wall 507, the respective upper edges of which are spanned by support runs 508 and 509 and wherein track means 511 and 513 extend inwardly above the support run. For use with two trays, the base may include a spacer 520 having a companionately engageable flange or track portion 521 and 523 to be inserted in the direction of the arrows 525 and 527 to a suitable location. Thereafter, one or more card holder and transfer trays, such as that shown in FIG. 18 may be slid into position above or in side-by-side location with a similar tray.

Figure 17:
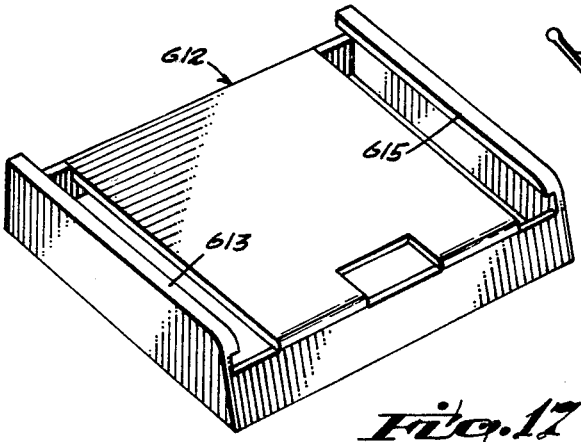
FIG. 17 is a perspective view of a single card holder and transfer tray base.
Figure 18:
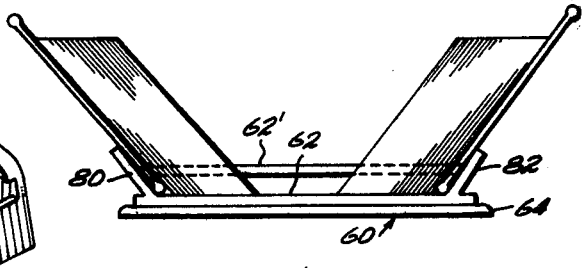
FIG. 18 is a side elevation view of a transfer tray holding cards.

Alternatively, a single mini-card holder and transfer tray base, such as that designated by the numeral 612 in FIG. 17 may be provided, which also includes track means 613 and 615 to mate with and receive the mini-card transfer tray shown in FIG. 18.

Figure 19:
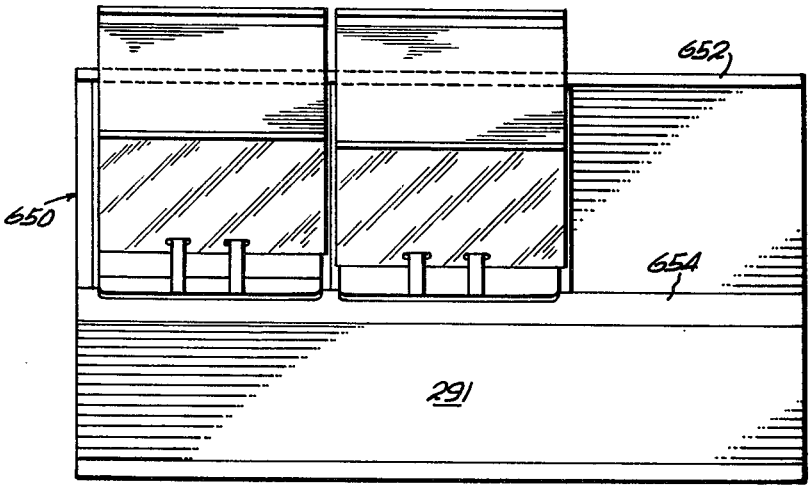
FIG. 19 is a plan view of a multi card holder and transfer tray base adapted to hold a pluarlity of trays in side-by-side relation and including a front zone for displaying a sheet with a calendar.
Figure 20:
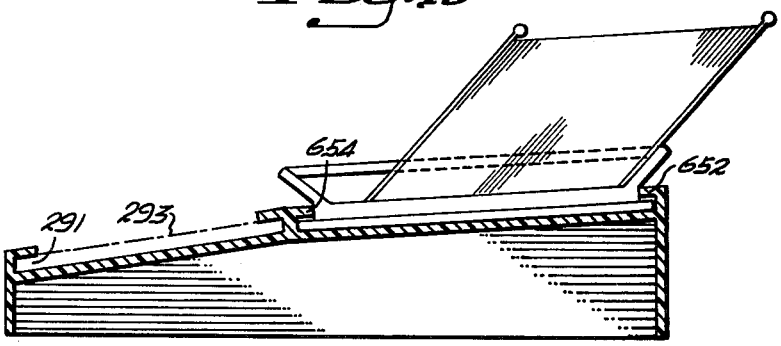
FIG. 20 is an elevation view in cross section taken on a mid-plane of FIG. 19.

Referring now to FIGS. 19 and 20 there is shown a multi base designated by the numeral 650 which includes space for one or more mini-card holder and transfer trays to be slidably received within track means 652 and 654 and wherein there is provided an additional forward track run 291 within which calendars or other sheet form material, such as 293, is adapted to be positioned, for conveniently recording the progress of work or in arranging work by a user of the system described herein.

Figure 21:
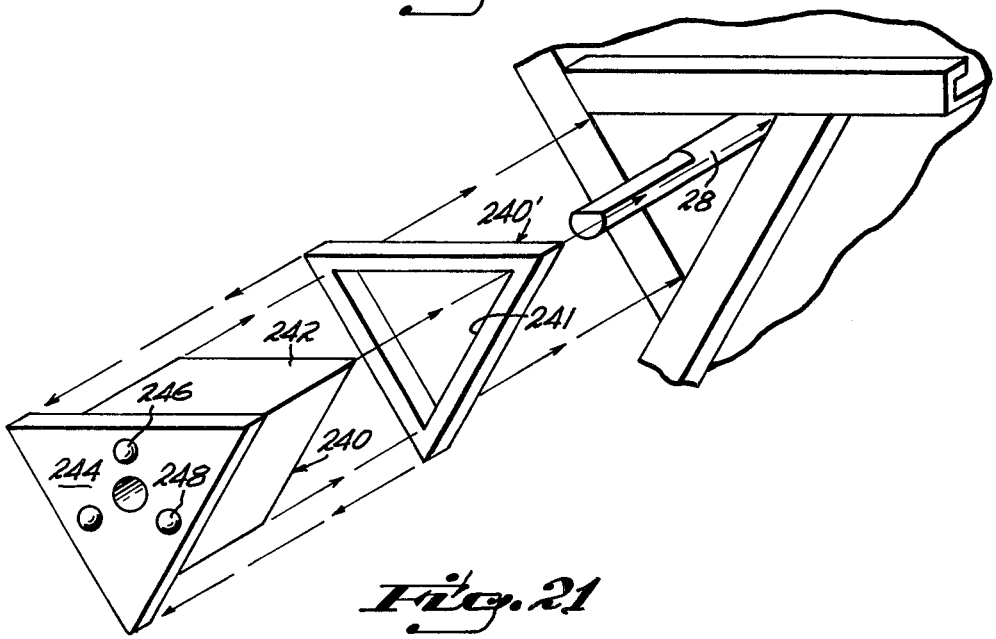
FIG. 21 is an exploded perspective view similar to FIG. 7 and illustrating the use of a triangular spacer ring.

Generally speaking, there has been provided a multi-sectional rotary card filing system which it is seen includes a central hub-like structure having extending fins providing individually formed open compartments, each of which compartment has formed channel members or track means suitably positioned to permit slide-in mini-card trays in either side-to-side runs or front-to-rear runs. This defines interchangeability of a common card tray which may be used in either type of housing, that is, with either type of fin, whether it is of the open or closed type unit. Further, each removable mini-card tray may have a full complement of cards and, if desired, indexes, whereby all cards contained in the housing will face in the forward position for easy and rapid filing of bulk cards. Also, individually formed track units are used in the side-to-side slide-in position and the same are automatically fixed into position where it is desirable to have the filed cards and indexes in a fixed position in each sectional compartment, or, if desirable, one or more sectional divisions may use a removable card tray or more in combination with a fixed card track unit, in a single card file. Also, it should be noted that wider card track units may be mounted on the housing in order to accommodate wider cards on an expanded housing. This same unit may be structured to accommodate more than one card size. This can be accomplished by adding an extension triangular ring 240' inserted on each side of the inner ends of the hub-like structure. These rings have a through recess 241 to telescopically receive the triangular portion 242, see FIG. 21. This interchangeability is accomplished by using the triangularly shaped ring-like structure in presized standard widths to equalize various card widths, for example, 2¼ and 4 inch cards can be increased to 3 × 5 card widths and 4 × 6 widths. In relation to removable card trays, which may be denominated as transfer card trays, there is provided a transfer base or transbase to permit slide-in mounting of transfer mini-card trays. The base will hold the card trays in a steady fixed position just above the desk surface in order to provide better handling as well as better visibility. The transfer base can be provided in horizontal lengths to accommodate more than one tray with its complement of cards and indexes; and, additionally, a slide-in separator may be provided in order to permit separation of the card trays for easier handling of the cards in each tray which is thus mounted.

It is thus seen that with the instant rotary filing system a user, who may first be attracted to the card tray on its transbase, will find the multi-unit transbase to be of advantage and, also, the rotary housing system providing ease of transfer of the mini-card trays to a single rotary housing adapted to store a large number of mini-cards. In this manner one may build up a substantial growing file system without the need to purchase a complete system initially, as the user moves from a mini-card tray to a plurality of mini-card trays requiring storage in a convenient manner, in which event the rotor and rotor support frame may be purchased.

It will be seen that in use the generally circularly disposed housing for the rotor, whether with or without the retractable cover, permits the card guard at the front of each deck to compress the cards in down movement of rotation and to support the card guards in the downward movement portion of the rotation of the rotor but always bringing the cards and index into the in-line filing position when rotation is continued. The horizontal structure of the opposing channel members permits slide-in, slide-out card trays to be held by positive means for sidewise insertion and removal, see the cut-away views of the drawings of this application. The single or multiple slide-in horizontal transfer bases house and retain the cards in filing position for supporting the removable mini-card trays which are adapted to be mounted on the transfer bases in order to raise the card trays for better filing and finding on the transfer base. The interchangeability of the internal assembly parts provides for uniform dies and molds which provide interchangeable parts for ease of assembly of different units reducing costs to purchasers. The use of the brake means or detent system described above provides for ease of rotation of the rotor and selective positioning in preselected attitudes of the tray support fins of the rotor. It should also be noted that the support members for the rotor frame or housing maintain the basic rotor structure in the preferred attitude and that the rotor frame is sized so as to compress the cards on their respective trays upon rotation of the cards on the rotor.

The card trays are universally flanged in the sense that tracks are provided on the edges to permit the use of the card trays when inserted in the rotary filing system whether in an in or out slide run or a side-to-side slide run and the same are also adapted to be utilized on the transfer bases providing a wide range of use for the instant system.

While the instant invention has been shown and described in what are considered to be practical and preferred embodiments, it is recognized that departures may be made therefrom within the scope of the claims as set forth herein which are to be accorded the full scope of the spirit of this invention and not to be limited except by the doctrine of equivalents.

What is claimed is:

1. A rotary card filing system structure, in combination, comprising:

a support frame including a first and second spaced side panel means, each panel means having a lower file support surface;

spacer means maintaining said side panel means in predetermined spaced relation; and a rotor spanning the support frame panel means and including means journaling said rotor to the frame for rotation about an axis generally perpendicular and through said first and second side panel means;

said rotor including a plurality of tray support fins, each of said tray support fins being of common size and of common shape and each having a support surface and a bottom surface and an outer edge, said outer edge being spaced a common radial distance from said rotor axis, and said edges tracing a circular cylindrical path about said rotor axis upon rotation of said rotor, each of said tray support fin edges being equi-angularly spaced from one another;

each of said tray support fins being supported by said rotor and extending depthwise relative to the rotor from said path along a chordal plane extending from said edge past a diametrical plane of said rotor perpendicular to said chord line, said tray support fins each having an inner end, and said inner end being supported at a zone by the adjacent tray support fin angularly adjacent said support surface, said zone being spaced depthwise from said path beyond said diametrical plane perpendicular to said chordal plane of the support fin and being supported intermediate the inner end and outer edge by the adjacent tray support fin angularly adjacent said bottom surface at a support area on said bottom surface, said support area being spaced inwardly from said outer edge a distance from said outer edge which is less than the distance to said diametrical plane perpendicular to the chordal plane of said support fin;

said rotor comprising a surface extending radially from said rotor axis to be responsive to a tangential force to selectively rotate the rotor and each of the fins so that the fins are adapted to be rotated into and oriented in generally horizontal attitudes;

a card holder and transfer tray having parallel inner and outer edges and parallel side edges sized to rest and ride on the support surface of each of said support fins between said outer edge and said zone and between said frame panel means in a predetermined position; and mutually interengaging means on each of the trays and each of the tray support fins maintaining said trays against vertical movement of separation of said trays from said rotor fins on rotation of said rotor and accommodating sliding movement of said card holder trays over said support face of said fins into and out of said predetermined position, said mutually interengaging means including stop means to limit sliding movement of the trays relative to their respective associated tray support fins when at said predetermined position;

each of said card holder trays including an inner and outer mini-card orienting rail structure parallel to the inner and outer edges at said inner and outer edges respectively and each of said rails diverging outwardly with respect to one another from said tray and each card holder and transfer tray including two spaced upstanding support tracks parallel to one another and parallel to the parallel side edges and extending across each card holder tray between the orienting rail structure and each of said tracks having an enlarged terminal edge;

a deck of mini-cards on at least one of the trays, each of said deck including a plurality of cards of common size, and each of said cards of said deck including a pair of recesses spaced and located relative to an edge thereof and sized for companionate engagement about said track means for sliding movement of said cards along said track and relative tilting movement of said cards relative to said track means and said cards and track means being in engagement to captivate said cards on said frame and said rotor to orient and yieldably hold said rotor in an attitude with a tray in a horizontal attitude.

2. The device as set forth in claim 1 wherein said spacer means comprises a cylindrical body spanning said first and second panel means and defining a closed front, rear and bottom wall of said rotor.

3. The device as set forth in claim 2 wherein said frame is provided with a rotatable hood means for access to said rotor, said hood means being rotatable about said axis between an open and closed position and including stop means on said hood means and said frame to limit movement of said hood means when in said open and in said closed position and constraining said hood means to a limited range of movement between said open and closed position.

4. The device as set forth in claim 1 wherein said mutually interengaging means comprises track means on said fins and trays in hooked-up relation.

5. The device as set forth in claim 1 wherein said support surface of said tray support fins comprises a generally planar surface.

6. The device as set forth in claim 1 wherein said deck includes an inner and an outer heavy duty resilient relatively rigid card guard sheet, said card guard sheet being slightly larger in all dimensions than said mini-cards of said deck and said card guard sheets including a pair of recesses spaced and located relative to an edge thereof sized for companionate engagement about said track means for slidable movement of said card guard sheets with the cards of said deck along said track and for relative tilting movement of said cards relative to said track means and said card guard and track means being in engagement.

7. The device as set forth in claim 1 wherein said stop means comprises clip means on each tray movable into and out of hooked-up engagement with said fins.

8. The device as set forth in claim 1 wherein a pad of rubbery material of a size smaller than the cards of said deck is provided and included on opposite sides of said deck.

9. The device as set forth in claim 1 wherein said mutually interengaging means on each of the trays and each of the tray support fins comprises means extending parallel to the centerline of said rotor.

10. The device as set forth in claim 1 wherein said mutually interengaging means on each of the trays and each of the tray support fins comprising track means extend perpendicular to diametrical planes through the centerline of said rotor.

11. The device as set forth in claim 1 wherein said means journaling said rotor to the frame includes triangular portions extending axially from said rotor comprising spacer means.

12. The device as set forth in claim 11 wherein said spacer means includes detent means engaging said support frame.

13. The device as set forth in claim 1 wherein turning knob means are provided exterior of the frame and means are provided connecting said turning knob means and rotor.

14. The device as set forth in claim 13 wherein said turning knob means includes positive positioning means for selectively orienting each of the fins in a horizontal attitude upon rotation of said rotor.

15. The device as set forth in claim 1 wherein transfer tray support means are provided including means to engage the transfer trays to support the same separate and apart from said rotor.

16. A plurality of combinations as set forth in claim 1 in side-by-side interconnected relation defining a bank.

* * * * *